US011656051B2

(12) United States Patent
Lee et al.

(10) Patent No.: US 11,656,051 B2
(45) Date of Patent: May 23, 2023

(54) BIPOD GRIP FOR FIREARMS

(71) Applicant: Strike Industries, Inc., Santa Ana, CA (US)

(72) Inventors: Shanyao Lee, Santa Ana, CA (US); Shih-Ting Hung, Taoyuan (TW)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/065,503

(22) Filed: Oct. 7, 2020

(65) Prior Publication Data

US 2022/0107155 A1 Apr. 7, 2022

(51) Int. Cl.
*F41A 23/10* (2006.01)
*F41C 23/16* (2006.01)

(52) U.S. Cl.
CPC ..... *F41A 23/10* (2013.01); *F41C 23/16* (2013.01)

(58) Field of Classification Search
CPC ..... F41A 23/02–16; F41C 23/12; F41C 23/16
USPC ..... 42/72, 94; 89/37.04, 40.01, 40.06
See application file for complete search history.

(56) References Cited

U.S. PATENT DOCUMENTS 3,632,073 A * 1/1972 Nakatani ..... F16M 11/14 248/169
4,029,246 A * 6/1977 Woodruff ..... F16M 11/048 396/428
4,545,660 A * 10/1985 Rudolf ..... F16M 13/04 396/425
5,029,407 A * 7/1991 Kirkpatrick ..... F41A 23/10 42/94
5,402,595 A * 4/1995 Tamllos ..... F41A 23/10 42/94
5,852,892 A * 12/1998 Bilgeri ..... F41A 23/08 42/94
6,289,622 B1 * 9/2001 Desch, Jr. ..... F41A 23/10 42/94
6,487,807 B1 * 12/2002 Kopman ..... F41A 23/12 42/72
7,111,424 B1 9/2006 Moody et al.
7,380,486 B1 * 6/2008 Bean ..... F41A 23/08 42/94
7,409,791 B2 * 8/2008 Moody ..... F41C 23/16 42/72
7,421,815 B1 9/2008 Moody et al.
7,584,568 B1 * 9/2009 Brownlee ..... F41C 23/16 89/37.01
7,676,979 B1 * 3/2010 Mertz ..... F41A 23/08 42/71.01

(Continued)

*Primary Examiner* — Joshua E Freeman
*Assistant Examiner* — Benjamin S Gomberg
(74) *Attorney, Agent, or Firm* — Han IP PLLC; Andy M. Han

(57) ABSTRACT

A device implementable on a firearm includes a housing, a connection portion and a support portion. The housing is configured with a void therein and has a first end and a second end opposite the first end. The connection portion is disposed at the first end of the housing and configured to couple the device to the firearm. The support portion is configured to be received in the void of the housing and, responsive to being pressed from two opposite sides, can retractably extend out of the void of the housing through an opening at the second end of the housing to form a bipod.

14 Claims, 9 Drawing Sheets

(56) References Cited

U.S. PATENT DOCUMENTS

| | | | | |
|---|---|---|---|---|
| 7,823,855 | B2 * | 11/2010 | Faifer | F16M 13/00 248/440.1 |
| 7,841,120 | B2 | 11/2010 | Teetzel et al. | |
| 8,650,791 | B2 * | 2/2014 | Williams | F41C 23/12 42/72 |
| 8,707,604 | B2 * | 4/2014 | Troy | F41A 23/10 42/72 |
| 9,784,521 | B2 * | 10/2017 | Bartak | F41A 23/10 |
| 10,480,891 | B2 * | 11/2019 | Eccleshall | F41A 23/10 |
| 10,591,240 | B2 * | 3/2020 | Beachli | F41A 23/08 |
| 2005/0241206 | A1 | 11/2005 | Teetzel et al. | |
| 2006/0277809 | A1 | 12/2006 | Moody et al. | |
| 2008/0052979 | A1 * | 3/2008 | Lee | F41A 23/08 42/73 |
| 2008/0307689 | A1 * | 12/2008 | Dotson | F41A 23/10 42/94 |
| 2009/0038199 | A1 * | 2/2009 | Oz | F41A 23/10 42/94 |
| 2009/0038200 | A1 * | 2/2009 | Keng | F41A 23/10 42/94 |
| 2009/0045304 | A1 | 2/2009 | Faifer | |
| 2009/0056192 | A1 | 3/2009 | Oz | |
| 2010/0146836 | A1 | 6/2010 | Moody et al. | |
| 2011/0173862 | A1 | 7/2011 | Williams | |
| 2018/0180375 | A1 * | 6/2018 | Macken | F41A 23/10 |

* cited by examiner

BIPOD GRIP FOR FIREARMS

TECHNICAL FIELD

The present disclosure is generally related to firearm accessories and, more particularly, to a bipod grip for firearms.

BACKGROUND

Unless otherwise indicated herein, approaches described in this section are not prior art to the claims listed below and are not admitted as prior art by inclusion in this section.

Among the various accessories a user of a firearm may consider to mount or install on the firearm, a foregrip is device that is typically installed under a barrel of the firearm to aid better gripping, handling as well as maneuverability of the firearm. Moreover, the same user may desire to attach a bipod to the firearm as the bipod tends to help support and provide stability to the firearm. However, as the bipod is also meant to be attached under the barrel of the firearm, it would be difficult to simultaneously attach a foregrip and a bipod, as separate accessories, to the firearm.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose various designs of a device that functions as a bipod grip for firearms. It is believed that the proposed design can avoid or otherwise minimize aforementioned issues associated with conventional bipod and foregrip as separate pieces of accessories. Moreover, it is believed the innovative locking mechanism of the design allows ease of extension of bipod legs when a user intends to deploy the bipod feature of the device, while keeping the bipod legs secured in the foregrip housing when the user does not intend to deploy the bipod feature.

In one aspect, a device implementable on a firearm (e.g., a rife, carbine, shotgun or pistol) may include a housing, a connection portion and a support portion. The housing may be configured with a void therein and may have a first end and a second end opposite the first end. The connection portion may be disposed at the first end of the housing and configured to couple the device to the firearm. The support portion may be configured to be received in the void of the housing and, responsive to being pressed from two opposite sides, further configured to retractably extend out of the void of the housing through an opening at the second end of the housing to form a bipod.

In another aspect, a device implementable on a firearm (e.g., a rife, carbine, shotgun or pistol) may include a housing and a support portion. The housing may be configured with a void therein and may have a first end and a second end opposite the first end. The support portion may be configured to move between a first configuration, in which the support portion is received in the void of the housing, and a second configuration, in which the support portion is retractably extended out of the void through an opening at the second end of the housing to form a bipod. Moreover, when in the first configuration, the support portion may be locked in the void of the housing by a mechanical feature on the housing. Furthermore, in response to being pressed from two opposite sides when in the first configuration, the support portion may become unlocked from the mechanical feature on the housing and is extendable out of the void of the housing.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
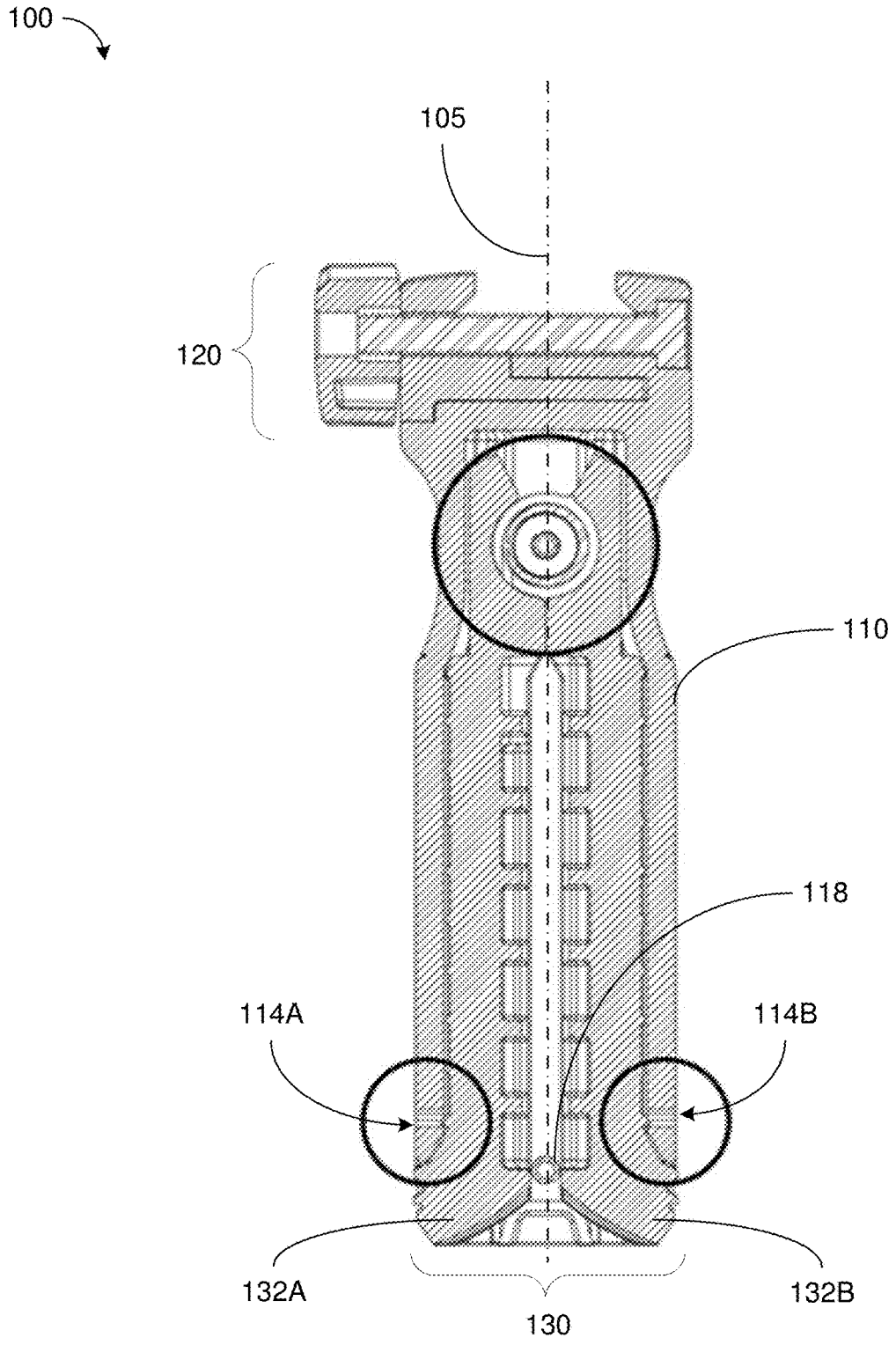
FIG. 1 is a diagram of a cross-sectional view of a device in a first configuration in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 6:
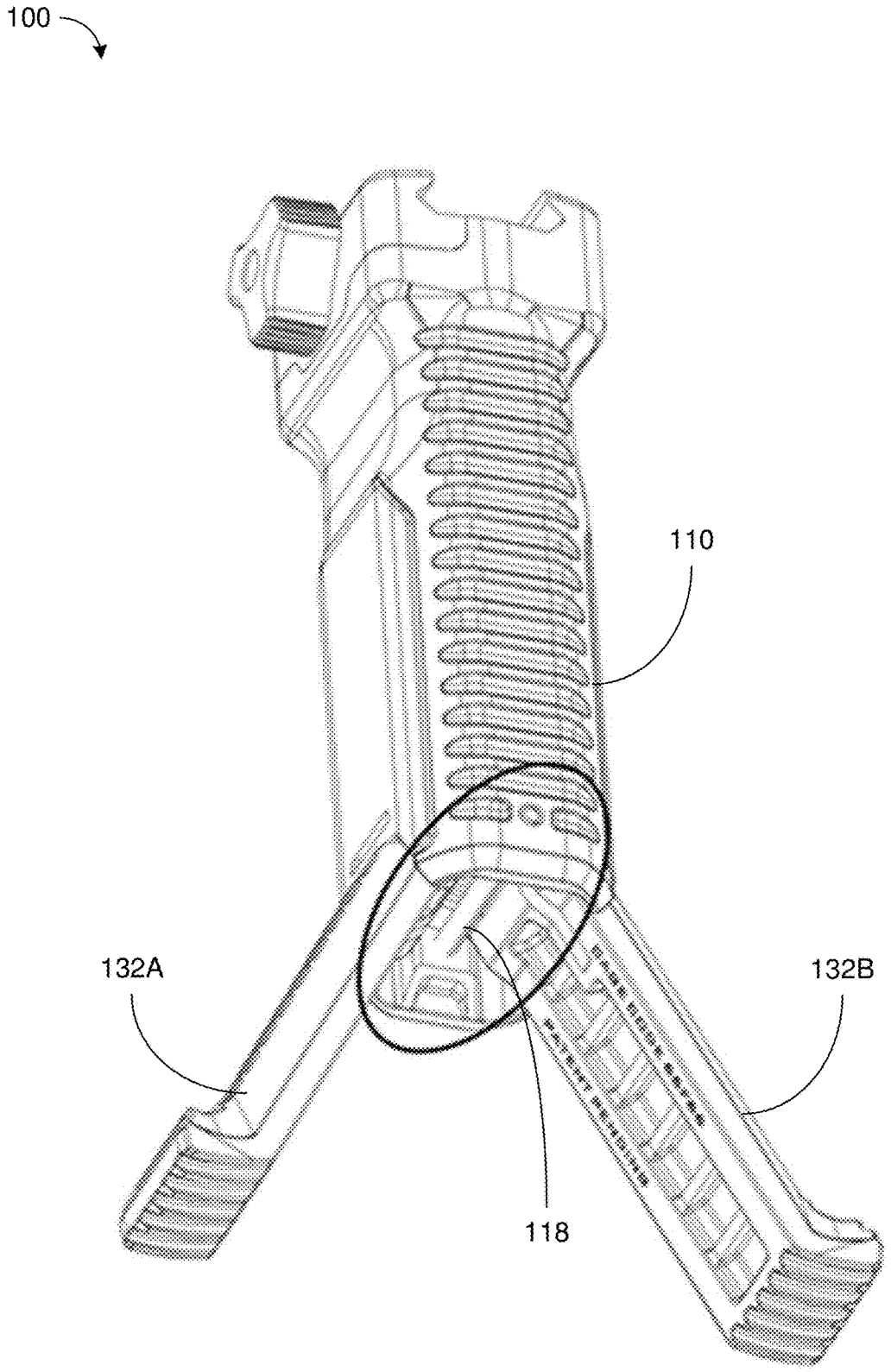
FIG. 6 is a diagram of a bottom perspective view of a device in a second configuration in accordance with an implementation of the present disclosure.
Figure 7:
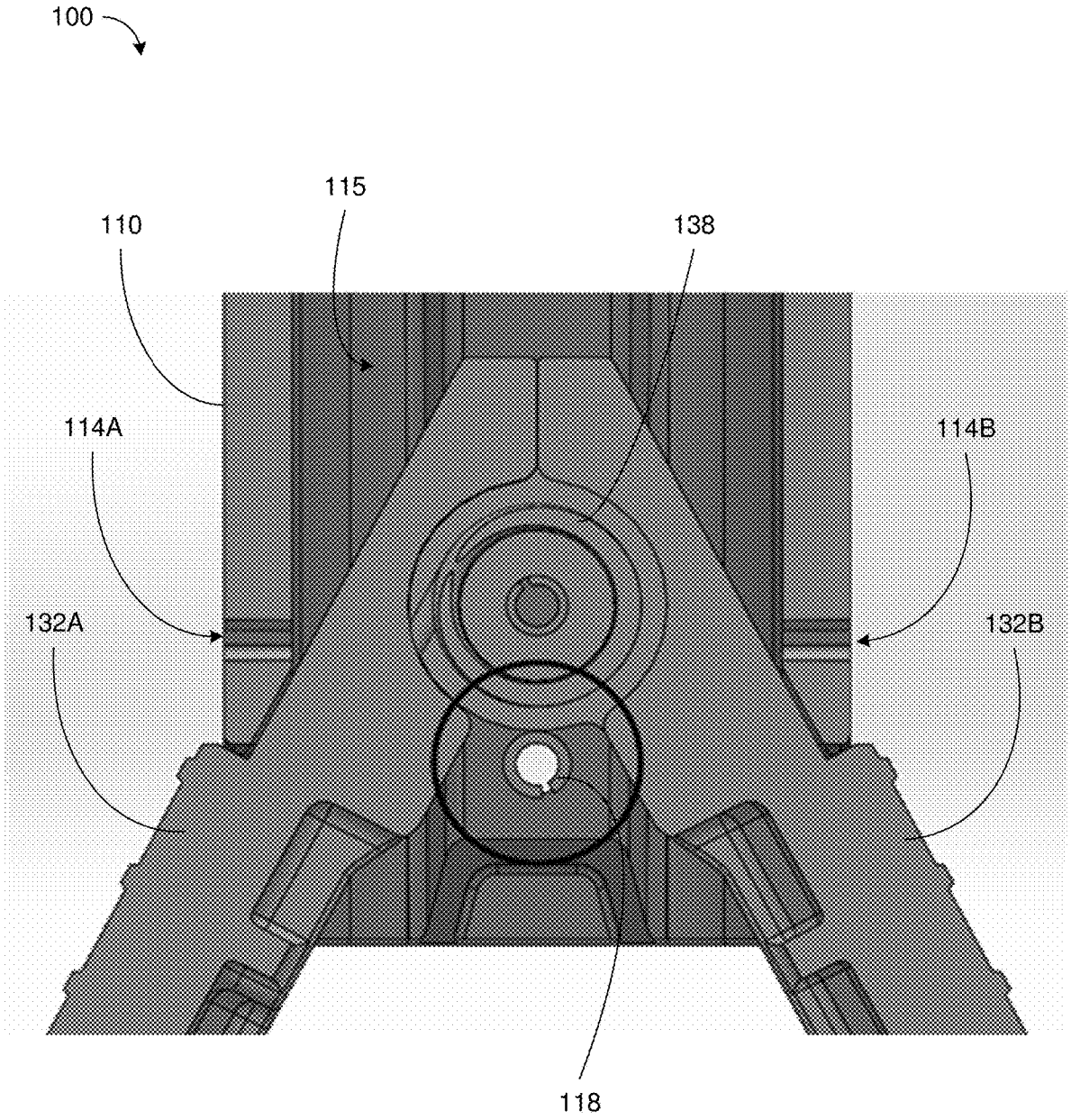
FIG. 7 is a diagram of an enlarged cross-sectional view of a portion of a device in a second configuration in accordance with an implementation of the present disclosure.
Figure 8:
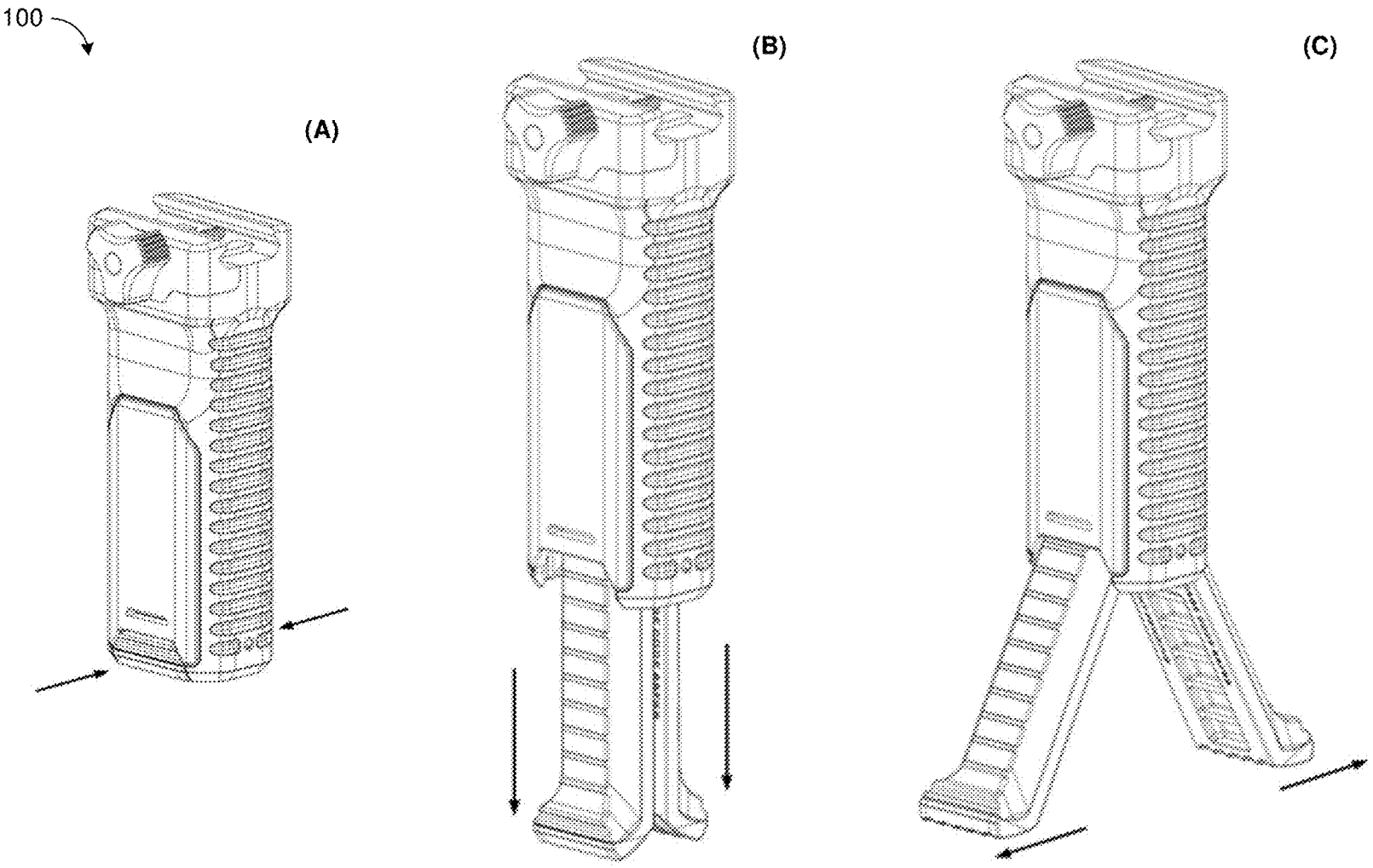
FIG. 8 is a diagram of showing a process of converting a device from a first configuration to a second configuration in accordance with an implementation of the present disclosure.
Figure 9:
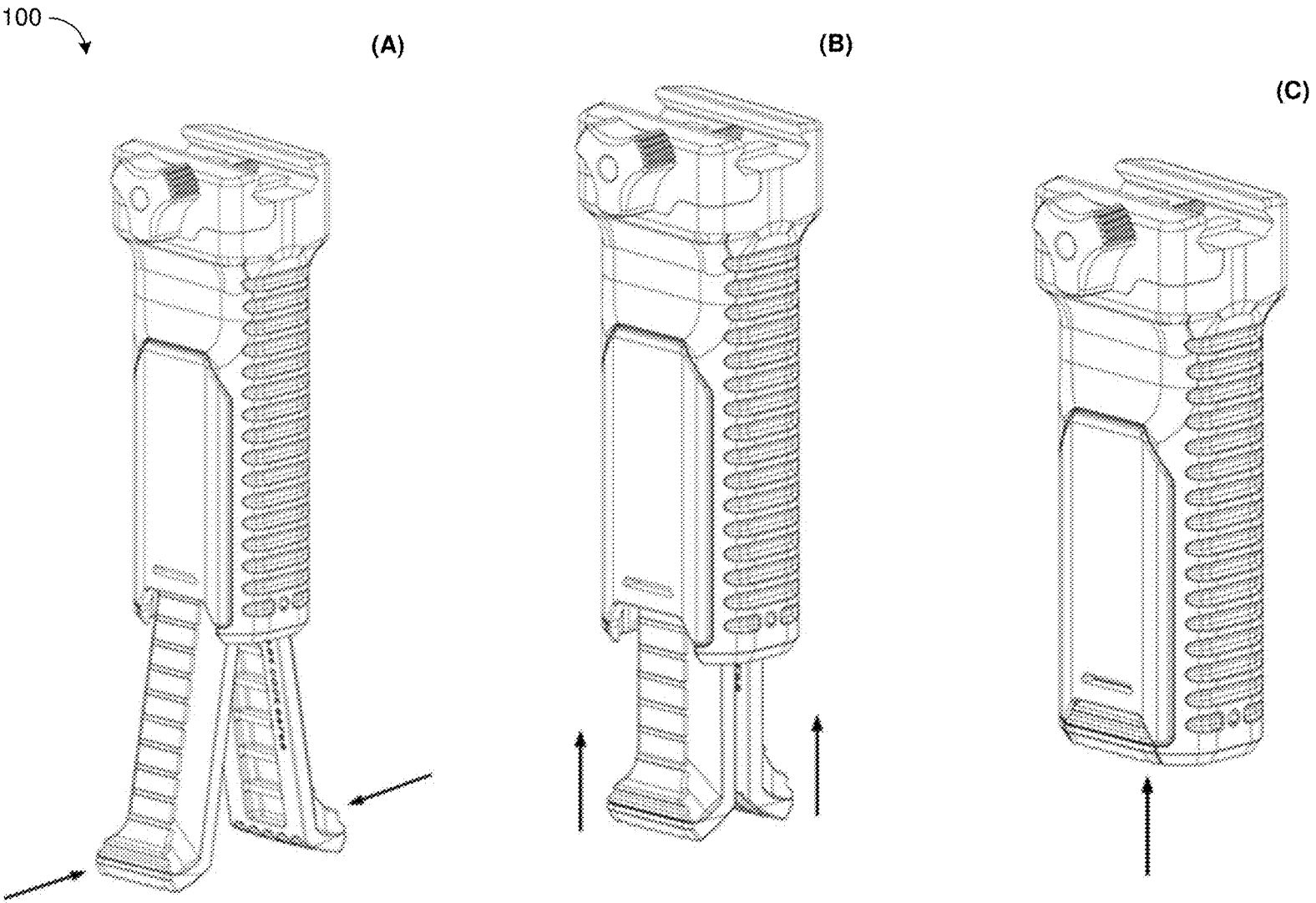
FIG. 9 is a diagram of showing a process of converting a device from a second configuration to a first configuration in accordance with an implementation of the present disclosure.

Each of FIG. 1~FIG. 7 illustrates a respective view and/or a respective portion of a device 100 in accordance with an implementation of the present disclosure. Each of FIG. 8 and FIG. 9 illustrates a respective process to convert device 100 from one configuration to another in accordance with an implementation of the present disclosure.

Referring to FIG. 1~FIG. 9, device 100 may be implemented on (e.g., attached to, installed on, or mounted on) a firearm such as a rife, carbine, shotgun or pistol. Device 100 may include a housing 110, a connection portion 120 and a support portion 130. Housing 110 may be configured with a void 115 therein and may have a first end (e.g., top end shown in the figures) and a second end (e.g., bottom end shown in the figures) opposite the first end. Connection portion 120 may be disposed at the first end of housing 110 and may be configured to couple device 100 to the firearm. For instance, connection portion 120 may have a screw-based attaching mechanism or a quick-disconnect (QD) mount that is configured to couple device 100 to a section of a Picatinny rail (also known as a "MIL-STD-1913 rail") or a Weaver rail on the firearm.

Figure 2:
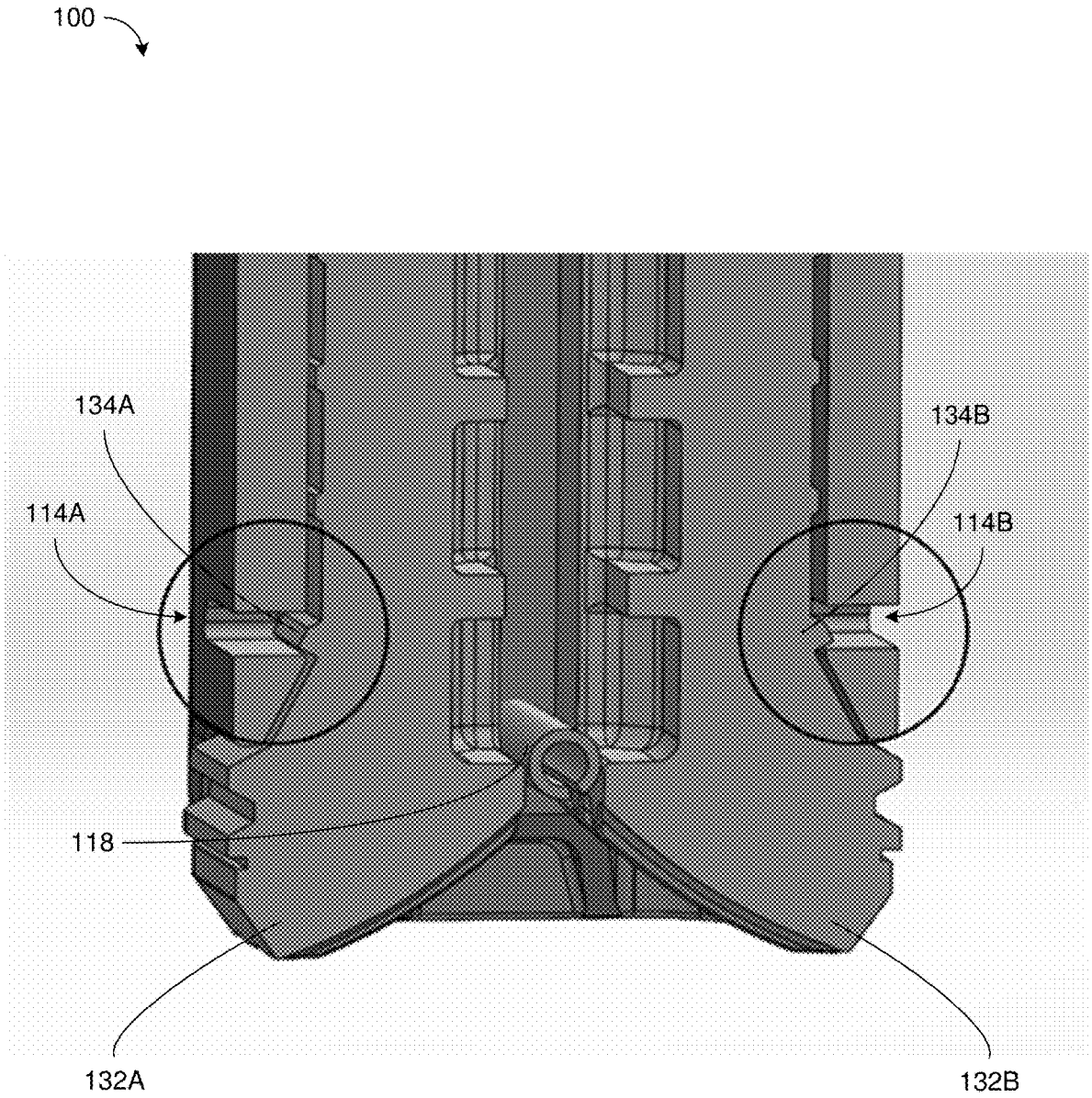
FIG. 2 is a diagram of an enlarged cross-sectional view of a portion of a device in accordance with an implementation of the present disclosure.

Support portion 130 may be configured to be received in void 115 of housing 110. In response to being pressed from two opposite sides (e.g., as shown in part (A) of FIG. 8) in directions generally or approximately radial or otherwise perpendicular to longitudinal axis 105 of device 100, support portion 130 may be configured to retractably extend out of void 115 of housing 110 (e.g., due to gravity or being pulled out by a user) through an opening at the second end of housing 110 to form a bipod. In other words, when support portion 130 is retracted or otherwise received in void 115 of housing 110 (e.g., as shown in FIG. 1, FIG. 2, part (A) of FIG. 8 and part (C) of FIG. 9), device 100 may be considered to be in a first configuration, in which device 100 looks like and functions as a foregrip. Moreover, when support 130 is extended out void 115 of housing 110 (e.g., as shown in FIG. 5, FIG. 6, FIG. 7, part (C) of FIG. 8 and part (A) of FIG. 9), device 100 may be considered to be in a second configuration, in which device 100 looks like and functions as a bipod (as well as a foregrip).

In one proposed design, support portion 130 may be configured to move between the first configuration, in which support portion 130 is received in void 115 of housing 110, and the second configuration, in which support portion 130 is retractably extended out of void 115 through an opening at the second end of housing 110. Accordingly, when in the first configuration, support portion 130 may be locked in void 115 of housing 110 by a mechanical feature on a wall of housing 110. Moreover, in response to being pressed from two opposite sides in directions generally or approximately radial or otherwise perpendicular to longitudinal axis 105 of device 100 when in the first configuration (e.g., as shown in part (A) of FIG. 8), support portion 130 may become unlocked from the mechanical feature on housing 110 and is extendable out of void 115 of housing 110.

Figure 3:
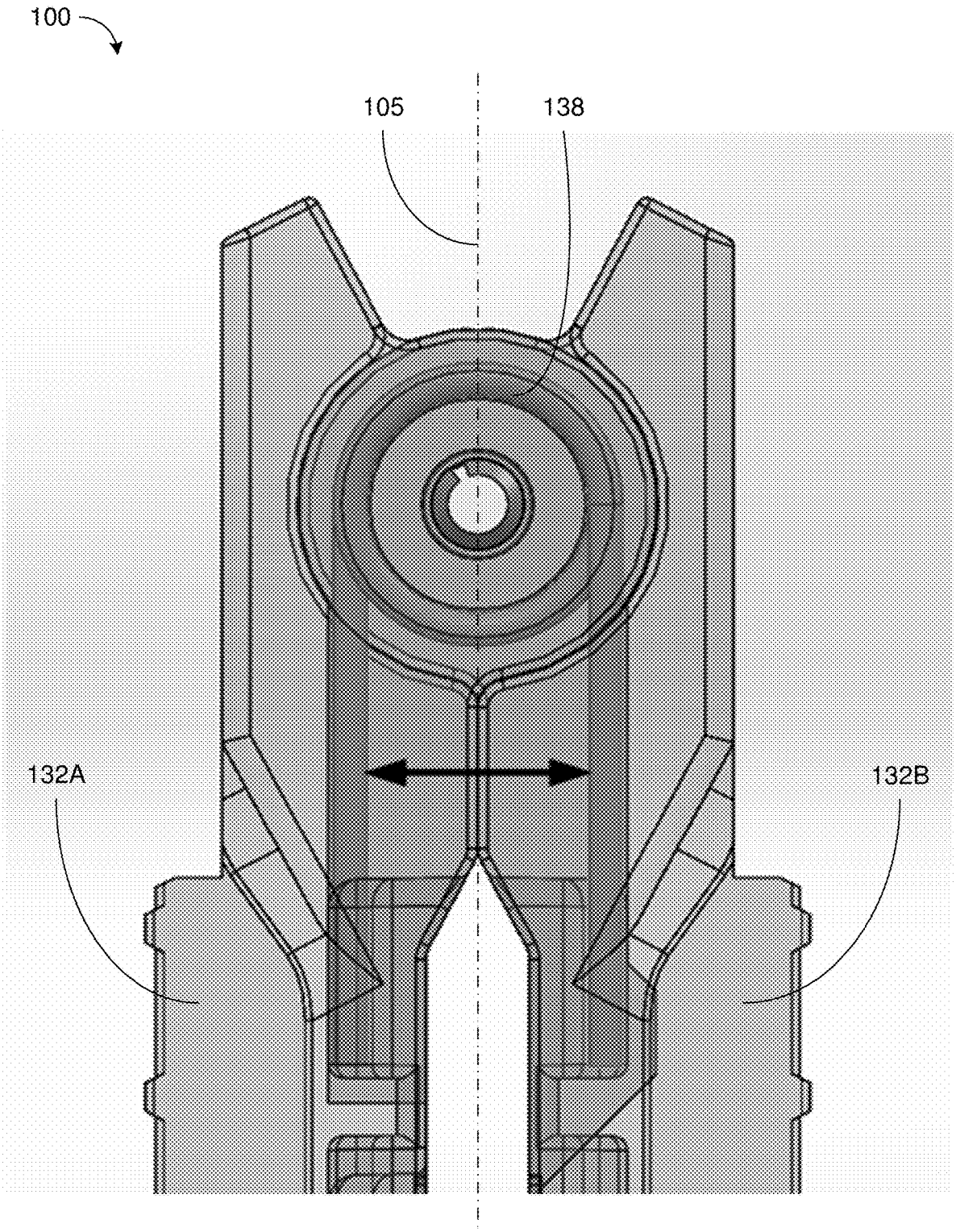
FIG. 3 is a diagram of an enlarged cross-sectional view of a portion of a device in a first configuration in accordance with an implementation of the present disclosure.
Figure 4:
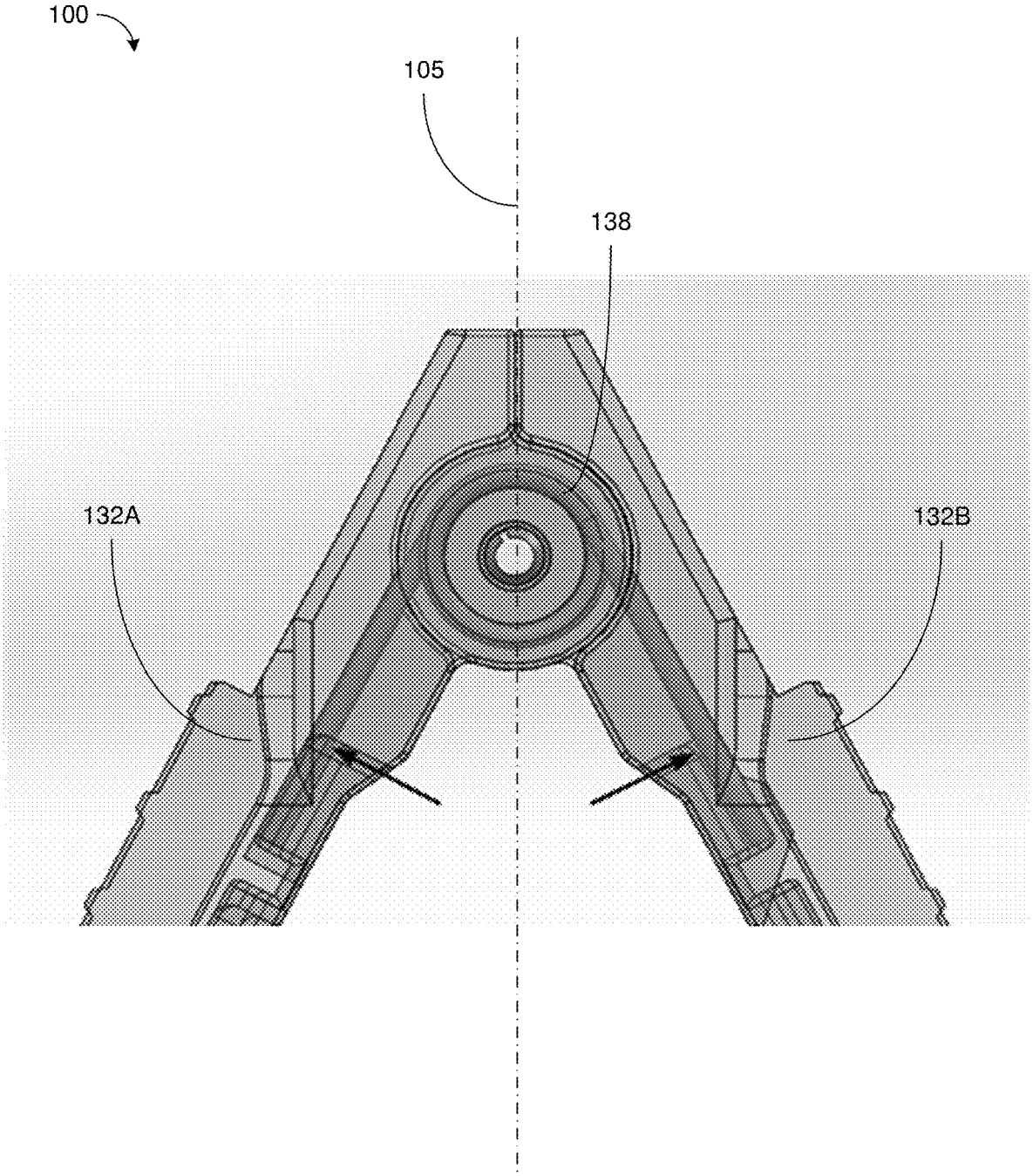
FIG. 4 is a diagram of an enlarged cross-sectional view of a portion of a device in a second configuration in accordance with an implementation of the present disclosure.

In one proposed design, support portion 130 may include two leg segments 132A and 132B as well as an elastic element 138. For instance, elastic element 138 may include a torsion spring or a compression spring. In such cases, elastic element 138 may be configured to exert a force on the two leg segments 132A and 132B (e.g., as shown in FIG. 3 and FIG. 4) to cause the two leg segments 132A and 132B to expand in opposite directions generally radial to a longitudinal axis 105 of device 100.

Figure 5:
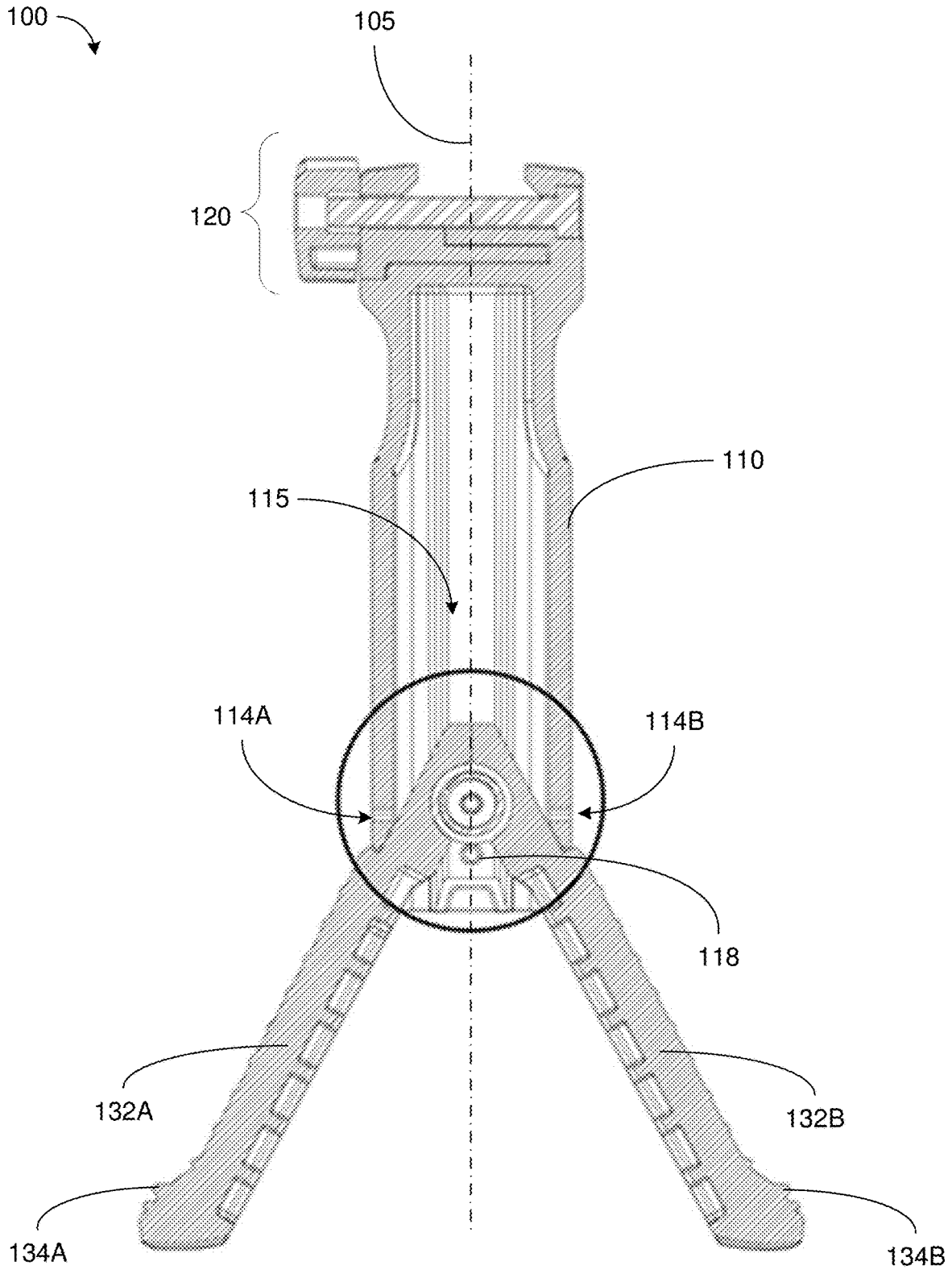
FIG. 5 is a diagram of a cross-sectional view of a device in a second configuration in accordance with an implementation of the present disclosure.

In one proposed design, each of the two leg segments 132A and 132B may be pivotably coupled to each other at a first distal end thereof (e.g., upper end as shown in FIG. 1, FIG. 3, FIG. 4, FIG. 5 and FIG. 7). In such cases, each of the two leg segments 132A and 132B may be configured with a respective protrusion 134A and 134B, respectively, near a second distal end thereof (e.g., lower end as shown in FIG. 1, FIG. 2 and FIG. 5) with the respective protrusion 134A/134B facing the wall of housing 110 when support portion 130 is received in void 115 of housing 110 in the first configuration.

In one proposed design, the mechanical feature on housing 110 may include two notches (not shown in the figures) on opposite sides of an inner surface of the wall of housing 110. In such cases, the respective protrusion 134A/134B on each of the two leg segments 132A and 132B may be accommodated in a respective one of the two notches when support portion 130 is received in void 115 of housing 110 in the first configuration to lock support portion 130 in housing 110, thereby preventing support portion 130 from sliding out of void 115 unintentionally. Advantageously, this design may ensure that support portion 130 is securely locked in void 115 when the user intends to use device 100 as a foregrip instead of a bipod.

Alternatively, the mechanical feature on housing 110 may include two through holes 114A and 114B on opposite sides of the wall of housing 110 (e.g., as shown in FIG. 1, FIG. 2, FIG. 5 and FIG. 7). In such cases, the respective protrusion 134A/134B on each of the two leg segments 132A and 132B may be accommodated in a respective one of the two through holes 114A and 114B when support portion 130 is received in void 115 of housing 110 in the first configuration to lock support portion 130 in housing 110, thereby preventing support portion 130 from sliding out of void 115 unintentionally. Advantageously, this design may ensure that support portion 130 is securely locked in void 115 when the user intends to use device 100 as a foregrip instead of a bipod.

In one proposed design, device 100 may further include a pin 118 disposed diagonally across the opening in void 115 of housing 110 at or near the second end of housing 110 (e.g., as shown in FIG. 1, FIG. 2, FIG. 5, FIG. 6 and FIG. 7). Advantageously, pin 118 may prevent support portion 130 from moving completely out of housing 110.

Referring to parts (A), (B) and (C) of FIG. 8, with device 100 initially in the first configuration as a foregrip, the user may simply press protrusions 134A and 134B simultaneously from two opposite directions to disengage protrusions 134A and 134B from the notches or through holes 114A and 114B on the wall of housing 110, thereby allowing support portion 130 to extend out of void 115 of housing 110 (e.g., due to gravity and/or pulling by the user) and be stopped by pin 118. As support portion 130 slides out of the opening at the second end of housing 110, the force exerted by elastic element 138 pushes the two leg segments 132A and 132B outwardly to result in leg segments 132A and 132B expanding to form a bipod. This process converts device 100 from the first configuration (foregrip) to the second configuration (as a bipod).

Referring to parts (A), (B) and (C) of FIG. 9, with device 100 initially in the second configuration as a bipod, the user may simply push support portion 130 upwardly (or inwardly with respect to void 115) to retract support portion 130 into void 115. This upward push acts against the force exerted by elastic element 138 and causes the two leg segments to retract or otherwise move inwardly toward the longitudinal axis 105 of device 100. When support portion 130 moves upwardly and back to its original position in the first configuration, the force exerted by elastic element 138 causes protrusions 134A and 134B to be respectively received or otherwise accommodated by the mechanical feature (whether notches or through holes 114A/114B) on the wall of housing, thereby locking support portion 130 in place.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). It is further noteworthy that each component of device 100 may be made of a suitable material (e.g., a suitable metal such as steel, aluminum or alloy) with appropriate mechanical properties such as sufficient strengths and/or hardness to withstand vibrations caused by firing of ammunition cartridges.

It is also noteworthy that, device 100 (as well as any derivative and/or variation thereof) may be implemented on other types of firearms such as, for example and without limitation, rifles, carbines, shotguns and/or pistols that are not based on the AR platform.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of bipod grip for firearms may be implemented in many ways. For illustrative purposes and without limiting the scope of the present disclosure, a few example implementations of the proposed design are described below.

In one aspect, a device implementable on a firearm (e.g., a rife, carbine, shotgun or pistol) may include a housing, a connection portion and a support portion. The housing may be configured with a void therein and may have a first end and a second end opposite the first end. The connection portion may be disposed at the first end of the housing and configured to couple the device to the firearm. The support portion may be configured to be received in the void of the housing and, responsive to being pressed from two opposite sides (e.g., in directions generally or approximately radial or otherwise perpendicular to a longitudinal axis of the device), further configured to retractably extend out of the void of the housing through an opening at the second end of the housing to form a bipod.

In some implementations, the support portion may be configured to move between a first configuration, in which the support portion is received in the void of the housing, and a second configuration, in which the support portion is retractably extended out of the void through an opening at the second end of the housing.

In some implementations, when in the first configuration, the support portion may be locked in the void of the housing by a mechanical feature on the housing. Moreover, responsive to being pressed from two opposite sides when in the first configuration (e.g., in directions generally or approximately radial or otherwise perpendicular to a longitudinal axis of the device), the support portion may become unlocked from the mechanical feature on the housing and is extendable out of the void of the housing.

In some implementations, the support portion may include two leg segments and an elastic element. In such cases, the elastic element may be configured to exert a force on the two leg segments to cause the two leg segments to expand in opposite directions generally radial to a longitudinal axis of the housing.

In some implementations, each of the two leg segments may be pivotably coupled to each other at a first distal end thereof. In such cases, each of the two leg segments may be configured with a respective protrusion near a second distal end thereof with the respective protrusion facing a wall of the housing when the support portion is received in the void of the housing in the first configuration.

In some implementations, the mechanical feature on the housing may include two notches on opposite sides of an inner surface of the wall of the housing. In such cases, the respective protrusion on each of the two leg segments may be accommodated in a respective one of the two notches when the support portion is received in the void of the housing in the first configuration to lock the support portion in the housing.

In some implementations, the mechanical feature on the housing may include two through holes on opposite sides of the wall of the housing. In such cases, the respective protrusion on each of the two leg segments may be accommodated in a respective one of the two through holes when the support portion is received in the void of the housing in the first configuration to lock the support portion in the housing.

In some implementations, the elastic element may include a torsion spring or a compression spring.

In some implementations, the connection portion may be configured to couple the device to a section of a Picatinny rail or a Weaver rail on the firearm.

In some implementations, the device may further include a pin disposed diagonally across the opening in the void of the housing near the second end of the housing. In such cases, the pin may prevent the support portion from moving completely out of the housing.

In another aspect, a device implementable on a firearm (e.g., a rife, carbine, shotgun or pistol) may include a housing and a support portion. The housing may be configured with a void therein and may have a first end and a second end opposite the first end. The support portion may be configured to move between a first configuration, in which the support portion is received in the void of the housing, and a second configuration, in which the support portion is retractably extended out of the void through an opening at the second end of the housing to form a bipod. Moreover, when in the first configuration, the support portion may be locked in the void of the housing by a mechanical feature on the housing. Furthermore, in response to being pressed from two opposite sides when in the first configuration (e.g., in directions generally or approximately radial or otherwise perpendicular to a longitudinal axis of the device), the support portion may become unlocked from the mechanical feature on the housing and is extendable out of the void of the housing.

In some implementations, the support portion may include two leg segments and an elastic element. In such cases, the elastic element may be configured to exert a force on the two leg segments to cause the two leg segments to expand in opposite directions generally radial to a longitudinal axis of the housing.

In some implementations, each of the two leg segments may be pivotably coupled to each other at a first distal end thereof. In such cases, each of the two leg segments may be configured with a respective protrusion near a second distal end thereof with the respective protrusion facing a wall of the housing when the support portion is received in the void of the housing in the first configuration.

In some implementations, the mechanical feature on the housing may include two notches on opposite sides of an inner surface of the wall of the housing. In such cases, the respective protrusion on each of the two leg segments may be accommodated in a respective one of the two notches when the support portion is received in the void of the housing in the first configuration to lock the support portion in the housing.

In some implementations, the mechanical feature on the housing may include two through holes on opposite sides of the wall of the housing. In such cases, the respective protrusion on each of the two leg segments may be accommodated in a respective one of the two through holes when the support portion is received in the void of the housing in the first configuration to lock the support portion in the housing.

In some implementations, the elastic element may include a torsion spring or a compression spring.

In some implementations, the device may further include a connection portion disposed at the first end of the housing and configured to couple the device to the firearm. In such cases, the connection portion may be configured to couple the device to a section of a Picatinny rail or a Weaver rail on the firearm.

In some implementations, the device may further include a pin disposed diagonally across the opening in the void of the housing near the second end of the housing. In such cases, the pin may prevent the support portion from moving completely out of the housing.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a housing with a void therein and having a first end and a second end opposite the first end, the housing having a locking mechanism comprising a mechanical feature on opposite sides of a wall of the housing;

a connection portion disposed at the first end of the housing and configured to couple the housing to the firearm; and a support portion configured to retract along a longitudinal axis of the housing and be received in the void of the housing and locked therein by the mechanical feature and, responsive to being pressed from two opposite sides, the support portion further configured to be unlocked from the mechanical feature and retractably extend out of the void of the housing along the longitudinal axis of the housing and through an opening at the second end of the housing to form a bipod, wherein the support portion comprises two leg segments and an elastic element, wherein each of the two leg segments is pivotably coupled to each other at a first distal end thereof, wherein each of the two leg segments is configured with a respective protrusion closer to a second distal end thereof than the first distal end with the respective protrusion facing the wall of the housing when the support portion is received in the void of the housing in a first configuration, wherein the mechanical feature on the housing comprises two notches or two through holes on opposite sides of an inner surface of the wall of the housing, wherein the respective protrusion on each of the two leg segments is accommodated in a respective one of the two notches or the two through holes such that the support portion is locked in the housing by retracting the leg segments linearly relative to the longitudinal axis of the housing to be received in the void of the housing and pushed outwardly by the elastic element, thereby causing the second distal end of each of the two leg segments to move outwardly to push the respective protrusion on each of the two leg segments into the respective one of the two notches or the two through holes, and wherein, when the support portion extends out of the housing and retracts into the housing, a relative movement of the support portion with respect to the mechanical feature is linear and parallel to the longitudinal axis of the housing.

2. The device of claim 1, wherein the support portion is configured to move between the first configuration, in which the support portion is received in the void of the housing, and a second configuration, in which the support portion is retractably extended out of the void through the opening at the second end of the housing.

3. The device of claim 2, wherein, when in the first configuration, the support portion is locked in the void of the housing by the mechanical feature on the housing, and wherein, responsive to being pressed from the two opposite sides when in the first configuration, the support portion becomes unlocked from the mechanical feature on the housing and is extendable out of the void of the housing.

4. The device of claim 3, wherein the elastic element is configured to exert a force on the two leg segments to cause the two leg segments to expand in opposite directions generally radial to the longitudinal axis of the housing.

5. The device of claim 4, wherein the elastic element comprises a torsion spring or a compression spring.

6. The device of claim 1, wherein the connection portion is configured to couple the housing to a section of a Picatinny rail or a Weaver rail on the firearm.

7. The device of claim 1, further comprising:

a pin disposed diagonally across the opening in the void of the housing closer to the second end of the housing than the first end of the housing, wherein the pin prevents the support portion from moving completely out of the housing.

8. A device implementable on a firearm, comprising:

a housing with a void therein and having a first end and a second end opposite the first end, the housing also having a locking mechanism comprising a mechanical feature on opposite sides of a wall of the housing; and a support portion configured to move between a first configuration, in which the support portion retracts along a longitudinal axis of the housing and is received in the void of the housing, and a second configuration, in which the support portion is retractably extended out of the void along the longitudinal axis of the housing and through an opening at the second end of the housing to form a bipod, wherein, when in the first configuration, the support portion is locked in the void of the housing by the mechanical feature on the housing, wherein, responsive to being pressed from two opposite sides when in the first configuration, the support portion becomes unlocked from the mechanical feature on the housing and is extendable out of the void of the housing, wherein the support portion comprises two leg segments and an elastic element, wherein each of the two leg segments is pivotably coupled to each other at a first distal end thereof, wherein each of the two leg segments is configured with a respective protrusion closer to a second distal end thereof than the first distal end with the respective protrusion facing the wall of the housing when the support portion is received in the void of the housing in the first configuration, wherein the mechanical feature on the housing comprises two notches or two through holes on opposite sides of an inner surface of the wall of the housing, wherein the respective protrusion on each of the two leg segments is accommodated in a respective one of the two notches or the two through holes such that the support portion is locked in the housing by retracting the leg segments linearly relative to the longitudinal axis of the housing to be received in the void of the housing in the first configuration and pushed outwardly by the elastic element, thereby causing the second distal end of each of the two leg segments to move outwardly to push the respective protrusion on each of the two leg segments into the respective one of the two notches or the two through holes, and wherein, when the support portion extends out of the housing and retracts into the housing, a relative movement of the support portion with respect to the mechanical feature is linear and parallel to the longitudinal axis of the housing.

9. The device of claim 8, wherein the elastic element is configured to exert a force on the two leg segments to cause the two leg segments to expand in opposite directions generally radial to the longitudinal axis of the housing.

10. The device of claim 9, wherein the elastic element comprises a torsion spring.

11. The device of claim 9, wherein the elastic element comprises a compression spring.

12. The device of claim 8, further comprising:

a connection portion disposed at the first end of the housing and configured to couple the housing to the firearm.

13. The device of claim 12, wherein the connection portion is configured to couple the housing to a section of a Picatinny rail or a Weaver rail on the firearm.

14. The device of claim 8, further comprising:

a pin disposed diagonally across the opening in the void of the housing closer to the second end of the housing than the first end of the housing, wherein the pin prevents the support portion from moving completely out of the housing.

* * * * *